United States Patent [19]

Cohen et al.

[11] 4,437,074

[45] Mar. 13, 1984

[54] ULTRAHIGH-FREQUENCY TRANSMISSION LINE OF THE THREE-PLATE AIR TYPE AND USES THEREOF

[75] Inventors: Georges Cohen; Jean Heroux, both of Paris, France

[73] Assignee: Thomson-CSF, Paris, France

[21] Appl. No.: 330,319

[22] Filed: Dec. 14, 1981

[30] Foreign Application Priority Data

Dec. 18, 1980 [FR] France ..... 80 26912

[51] Int. Cl.[3] ..... H01P 3/08; H01P 5/12

[52] U.S. Cl. ..... 333/128; 333/246; 333/244

[58] Field of Search ..... 333/238, 244, 246, 128, 333/136

[56] References Cited

U.S. PATENT DOCUMENTS

| | | | |
|---|---|---|---|
| 2,877,427 | 3/1959 | Butler | 333/238 X |
| 3,303,439 | 2/1967 | Fulp | 333/246 |
| 4,365,222 | 12/1982 | Lampert | 333/238 |

*Primary Examiner*—Paul L. Gensler

*Attorney, Agent, or Firm*—Roland Plottel

[57] ABSTRACT

The present invention provides an ultrahigh-frequency transmission line of the three-plate air type comprising two parallel conducting plates, the space separating these two plates being filled with air, a central conducting strip placed between said two plates and a plurality of dielectric material supports spread out along each side of said strip, each support comprising a notch in each of which said strip is positioned so as to be held in place.

15 Claims, 6 Drawing Figures

ULTRAHIGH-FREQUENCY TRANSMISSION LINE OF THE THREE-PLATE AIR TYPE AND USES THEREOF

BACKGROUND OF THE INVENTION

The present invention relates generally to electromagnetic wave transmission lines and relates more particularly to a transmission line of the three-plate air type operating at ultrahigh frequency.

Generally, it is known that a line of the three-plate air type comprises two parallel conducting plates, spaced apart from each other, and connected electrically together, the space separating these two plates being filled with air serving as dielectric, and a central conducting strip placed between the two plates and parallel thereto.

However, the usual construction of ultrahigh-frequency lines of the three-plate type makes use of a dielectric material plate arranged between the two flat conductors. Thus, one of these known three-plate lines comprises a plate forming a dielectric material support, made for example from glass-Teflon, placed between the two conducting plates and on which is disposed, for example by photo-etching, the central conducting strip. Furthermore, said support-forming plate is held in place by means of a plurality of metal posts arranged in alignment on each side of the conducting strip and mounted in twos by superimposition between said strip and the two conducting plates, respectively.

However, such a three-plate line presents drawbacks. In fact, because of the presence of the dielectric material support, this type of line is limited in length, of the order of 1 m. Furthermore, the dielectric material forming the support has a poor temperature resistance, causing consequently deformation thereof. Moreover, the metal posts with reduced distance between axes are indispensable for suppressing the evanescent modes due to the presence of the dielectric support. This line is therefore expensive, of a relatively high weight and causes high losses.

SUMMARY OF THE INVENTION

The present invention aims at remedying these drawbacks by providing a three-plate line whose dielectric is air, which is inexpensive, small in weight, has a very good power resistance, causes small losses and is capable of being mass-produced and may be of a great length, of the order of 3 m and more.

To this end, the invention provides an ultrahigh-frequency transmission line comprising two parallel conducting plates, spaced apart from each other and connected electrically together, the space separating these two plates being filled with air and a central conducting strip placed between the two plates and parallel thereto, characterized in that it comprises a plurality of pieces forming dielectric material supports spread out along each side of the strip, each one being integral with the two conducting plates and in that each support-forming piece comprises a notch in each of which the strip is positioned so as to be held in place.

The invention also relates to the use of the ultrahigh-frequency transmission line of the invention, this use being characterized by the fact that the line forms a power divider of great length supplying a group of radiating sources disposed in alignment.

DESCRIPTION OF THE DRAWINGS

Other characteristics and advantages of the invention will be better understood from the detailed description which follows with reference to the accompanying drawings, given solely by way of example and in which.

DESCRIPTION OF THE PREFERRED EMBODIMENTS

Figure 1:
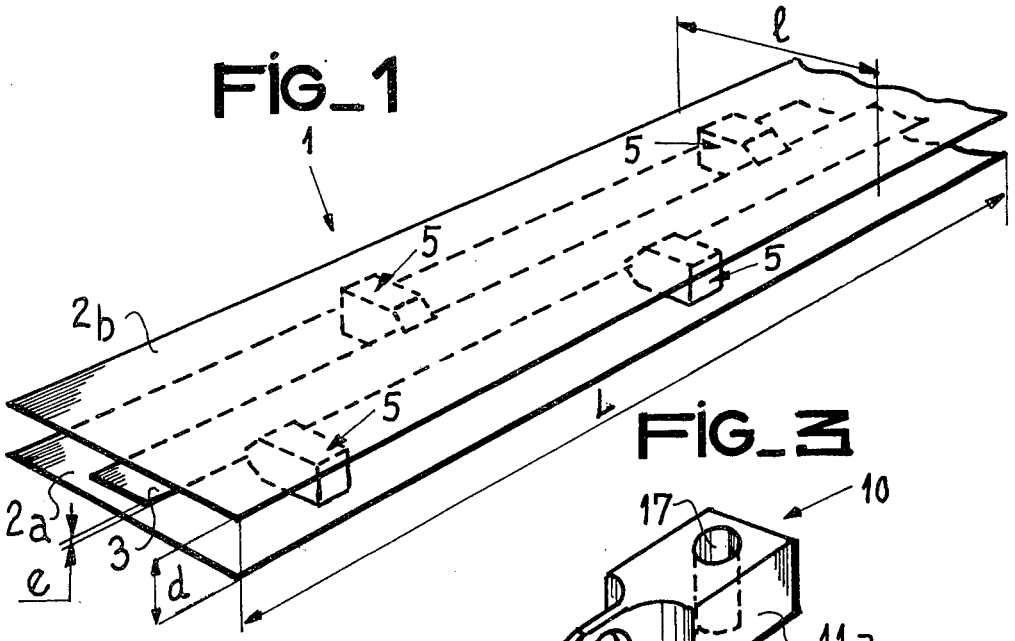
FIG. 1 is a perspective view of the ultrahigh-frequency transmission line of the invention.

According to one embodiment, and referring to FIG. 1, an ultrahigh-frequency transmission line 1, of the three-plate air type, in accordance with the invention, comprises two lower 2*a* and upper 2*b* rectangular parallel conducting plates of a width l and a length L, spaced apart from each other by a distance d and connected electrically together, and a conducting strip 3, of a thickness e, placed in the middle between the two plates 2*a* and 2*b* and parallel thereto. The space separating strip 3 from the respective plates 2*a* and 2*b* is filled with air. The two conducting plates 2*a* and 2*b* and the conducting strip 3 are formed from a good conducting metal, such for example as electrolytic copper. Moreover, the central strip 3 is obtained either by chemical etching or by machining.

It should be noted that the two conducting plates 2*a* and 2*b* may be replaced by two plates made from a dielectric material covered with a metal layer, without departing from the scope of the invention.

As can be seen in FIG. 1, the three-plate air line 1 further comprises a plurality of pieces forming supports 5 in accordance with a first embodiment, made from a dielectric material having a low loss tangent, spread out alternately on each side of the central strip 3 and over the whole length of said strip. Preferably, the distance separating two alternate supports 5 is equal to $\lambda/4$.

Figure 2:
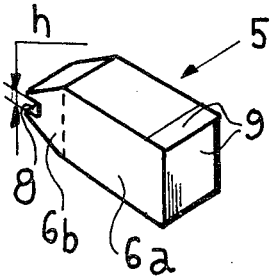
FIG. 2 is a perspective view of a dielectric support according to a first embodiment.

According to this embodiment shown in FIG. 2, each support 5 is in the form of a parallelepipedic block 6*a* extended by an additional block 6*b* substantially triangular in shape in longitudinal section. At the end of block 6*b* is provided a notch 8, of a height h equal to the thickness e of strip 3, extending transversely with respect to the longitudinal axis of the parallelepipedic block 6*a*. Each support 5 is obtained for example by molding and is made from a light material, such for example as expanded foam.

During the manufacture of the three-plate air line 1, each support 5 such as shown in FIG. 2 is mounted transversely with respect to the central strip 3, the lower face of the parallelepipedic block 6*a* of each support 5 being fixed, for example by bonding, to the lower conducting plate 2*a*. The conducting strip 3 is positioned in the notches 8 of supports 5 so as to be held in place and the upper conducting plate 2*b* is mounted so as to bear on the upper face of the parallelepipedic block 6*a* of each support 5. The two conducting plates 2a and 2b are firmly interlocked to each other by any appropriate securing system, formed for example by rivets.

As can be seen in FIG. 2, the lower and upper faces of the parallelepipedic block 6a of each support 5 may be partially covered with a metal layer 9, of zinc, formed for example by spraying, whereas the endmost face of the parallelepipedic block 6a may be wholly covered with this same metal layer 9, thus ensuring the electrical connection between the two conducting plates 2a and 2b.

Figure 3:
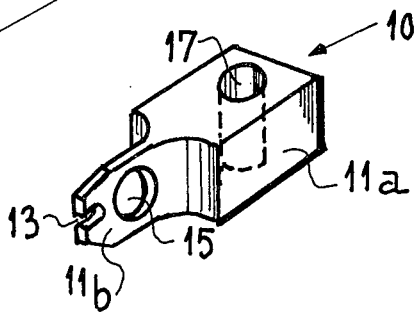
FIG. 3 is a perspective view of a dielectric support according to a second embodiment.

According to a second preferred embodiment, shown in FIG. 3, each support-forming piece 10 is in the form of a parallelepipedic block 11a comprising a longitudinal tapering extension 11b at the end of which is formed a notch 13, of a height equal to the thickness e of strip 3, and in which the conducting strip 3 is positioned so as to be held in place.

Each support 10 is obtained by molding, and is made from a hard material, such for example as fluorine-containing resin (Teflon) or polyphenylene oxide. Moreover, the tapering part 11b of each support 10 comprises a recess 15 for avoiding any disturbance of the electric field within the three-plate line.

During fabrication of the three-plate air line 1, each support 10 such as shown in FIG. 3 is mounted transversely with respect to the conducting strip 3, the lower and upper faces of each parallelepipedic block 11a being placed so as to bear on the lower 2a and upper 2b conducting plates respectively. As is shown in FIG. 3, the parallelepipedic block 11a of each support 10 comprises a through-hole 17 in which is engaged a metal distance-piece (not shown) providing fixing of each support 10 with the two conducting plates 2a and 2b as well as the electric connection of these two plates.

Figure 4:
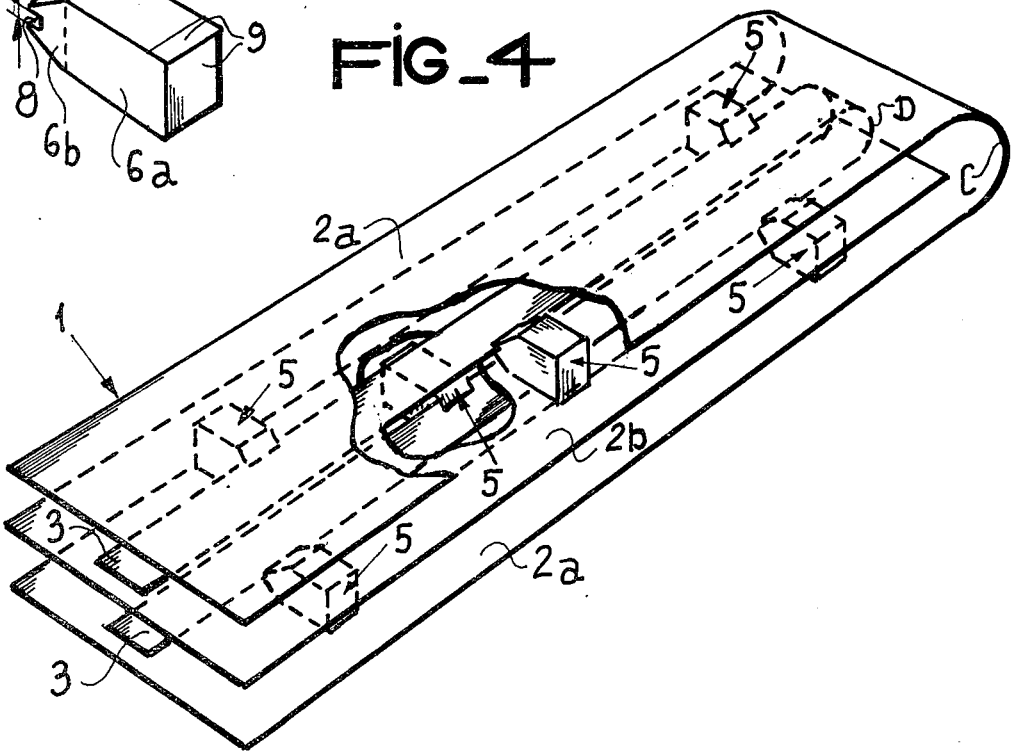
FIG. 4 is a perspective view, with parts cut away, of the transmission line of the invention in the folded-up position.

So as to reduce the space occupancy in depth of the three-plate air line 1 which has just been described, this latter may be turned back or folded over onto one of the two conducting plates 2a or 2b. Thus, as is shown in FIG. 4, the three-plate line 1 is folded back over its upper plate 2b by bending its lower plate 2a and its central strip 3, thus creating superimposition of two three-plate air lines. There is shown at C and D the bending of the lower plate 2a and of the central strip 3, respectively.

Figure 5:
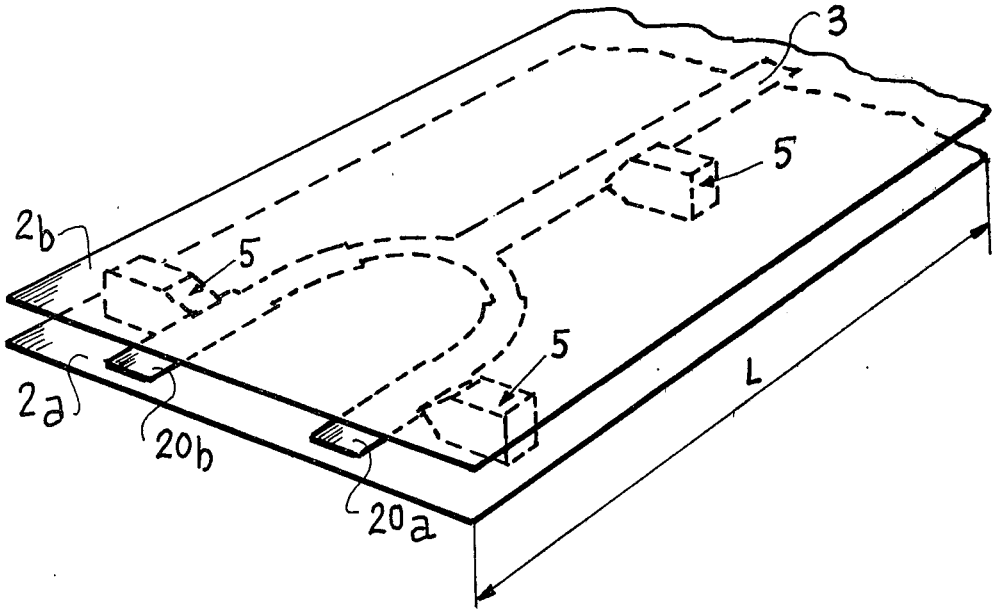
FIG. 5 is a perspective view of the transmission line of the invention for a power divider.

One of the possible uses of the three-plate air line of the invention consists in the construction of a power divider of great length supplying a group of radiating sources disposed in alignment. There is shown in FIG. 5 a discrete element of the power divider whose central strip 3 ends for example in two branches 20a and 20b each intended to supply with power a radiating source (not shown).

As another use of the three-plate air line of the invention, there may be mentioned, by way of nonlimiting example, the construction of a radiating element, such for example as a half-wave dipole, and the construction of a ring.

Figure 6:
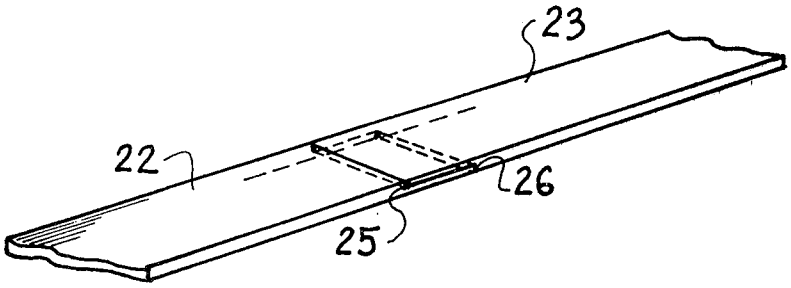
FIG. 6 is a perspective view of two conducting strips, showing the connection thereof.

In the case of the construction of a power divider of great length, of the order of 3 m, this is formed by two three-plate air lines of the invention connected together. More precisely, as is shown in FIG. 6, the conducting strips 22 and 23 of the two lines intended to be connected together, comprise two complementary set-backs 25 and 26, obtained for example by chemical cutting out, and provided at their respective ends. Thus, the two strips 22 and 23 are fitted into one another, then are fixed to one another for example by welding. It should be noted that this connection by means of complementary set-backs allows the strips once connected together to retain a good temperature resistance.

By way of illustration, the Applicant has manufactured a three-plate air line transmitting a power greater than 40 KW peak and generating losses of the order of 0.2 dB/m in the "S" band.

What is claimed is:

1. An ultrahigh frequency transmission line comprising:

two parallel conducting plates spaced apart from each other and connected electrically together, the space separating these two plates being filled with air;

a central conducting strip placed between said two plates and parallel thereto; and a plurality of support pieces made from a dielectric material and spread out along each side of said strip, each support piece being a parallelpipedic block mounted transversely with respect to said strip and having lower and upper faces on which said two conducting plates are respectively placed so as to bear on said faces of said block, each of said blocks comprising a longitudinal tapered extension and a notch provided at the end of said extension in which a side of said strip is positioned so as to be held in place.

2. A line as claimed in claim 1, wherein each said block further comprises a recess formed in said longitudinal tapered extension.

3. A line as claimed in claims 1 or 2, wherein each said block further comprises a through-hole in which is intended to be engaged a metal distance-piece ensuring fixing of said block between said two conducting plates as well as electric connection of said two plates.

4. A line as claimed in claim 1, wherein each of said support pieces is made from polyphenylene oxide.

5. An ultrahigh-frequency transmission line comprising:

two parallel conducting plates spaced apart from each other connected electrically together, the space separating these two plates being filled with air;

a central conducting strip placed between said two plates and parallel thereto; and a plurality of support pieces made from a dielectric material and spread out along each side of said strip, each support piece being a parallelpipedic block mounted transversely with respect to said strip and having lower and upper faces on which said two conducting plates are respectively placed so as to bear on said faces of said block, each of said blocks being extended longitudinally by an additional block substantially triangular in longitudinal section and comprising a notch provided at the end of said additional block in which the side of said strip is positioned so as to be held in place.

6. A line as claimed in claim 5, wherein said lower face of each said parallelpipedic block is fixed by bonding to one of said conducting plates.

7. A line as claimed in claim 5, wherein said upper and lower faces and the endmost face of each said parallelpipedic block are covered with a metal layer formed by spraying, ensuring electrical connection between said two conducting plates.

8. A line as claimed in claim 5, wherein each said support piece is made from expanded foam.

9. A line as claimed in claims 1 or 5, wherein said support pieces are spread out alternately on each side of said strip and over the whole length thereof.

10. A line as claimed in claims 1 or 5, wherein said strip is obtained by chemical cutting out.

11. A line as claimed in claims 1 or 5, wherein said two conducting plates and said strip form an assembly which is folded back over one of said two conducting plates.

12. A use of a transmission line as claimed in claims 1 or 5, wherein said line forms a power divider of great length supplying a group of radiating sources disposed in alignment.

13. A use as claimed in claim 12, wherein, so as to obtain said power divider of great length, this latter comprises two transmission lines connected together by means of two complementary set-backs formed respectively at one end of the conducting strip of each of said two lines, thus the two conducting strips are firmly connected together by positioning in said complementary set-backs.

14. A use as claimed in claim 13, wherein said two conducting strips are fixed to one another by welding.

15. A use as claimed in claim 13, wherein said two set-backs are obtained by chemical cutting out on said two conducting strips, respectively.

* * * * *